US011732707B2

(12) United States Patent
Sanford

(10) Patent No.: US 11,732,707 B2
(45) Date of Patent: Aug. 22, 2023

(54) INLET VALVE SYSTEM

(71) Applicant: DRESSER-RAND COMPANY, Houston, TX (US)

(72) Inventor: Joel T. Sanford, Bath, NY (US)

(73) Assignee: SIEMENS ENERGY, INC., Orlando, FL (US)

( * ) Notice: Subject to any disclaimer, the term of this patent is extended or adjusted under 35 U.S.C. 154(b) by 72 days.

(21) Appl. No.: 17/341,572

(22) Filed: Jun. 8, 2021

(65) Prior Publication Data

US 2022/0389924 A1 Dec. 8, 2022

(51) Int. Cl.
*F04B 53/10* (2006.01)
*F04B 49/22* (2006.01)
*F04B 7/00* (2006.01)

(52) U.S. Cl.
CPC ..... *F04B 53/10* (2013.01); *F04B 7/00* (2013.01); *F04B 49/22* (2013.01)

(58) Field of Classification Search
CPC ..... F04B 49/03; F04B 49/035; F04B 49/24; F04B 49/243; F04B 49/22; F04B 7/00; F04B 53/10
USPC ..... 417/505, 510
See application file for complete search history.

(56) References Cited

U.S. PATENT DOCUMENTS 8,070,461 B2 12/2011 Sanford
11,015,591 B2 * 5/2021 Sanford ..... F04B 49/06
2004/0091365 A1 * 5/2004 Spiegl ..... F04B 39/08 417/298
2014/0294619 A1 10/2014 Mangiagli
2019/0293064 A1 * 9/2019 Sanford ..... F04B 49/06

FOREIGN PATENT DOCUMENTS

DE 1114272 B 9/1961
WO 2016188800 A1 12/2016
WO 2018009402 A1 1/2018
WO 2020251530 A1 12/2020

OTHER PUBLICATIONS

PCT International Search Report and Written Opinion dated Jul. 20, 2022 corresponding to PCT Application PCT/US2022/030651 filed May 24, 2022.

* cited by examiner

*Primary Examiner* — Philip E Stimpert
(74) *Attorney, Agent, or Firm* — Enrique J. Mora

(57) ABSTRACT

An inlet valve system (10), as may be used for a cylinder chamber (20) of a compressor, such as a reciprocating compressor, is disclosed. A plurality of inlet valves (250) is movable between an open position and a closed position. The plurality of inlet valves is arranged between an unloader chamber (120) and a cylinder chamber (20) of the compressor. A control valve (270, 270') is coupled to a controller (300) and is movable between a first position and a second position to close the inlet valves. A check valve (260, 260') is movable between a first position and a second position to open the inlet valves. The check valve and the control valve are respectively fluidly coupled to a control chamber (252), which is decoupled from any pressure control external to cylinder chamber (20).

29 Claims, 4 Drawing Sheets

INLET VALVE SYSTEM

FIELD

Disclosed embodiments relate generally to compressor valves, and, more particularly, to an inlet valve system, as may be used in a compressor, such as a reciprocating compressor.

BACKGROUND

A reciprocating compressor is one example of positive displacement turbomachinery. In a reciprocating compressor, a fluid to be compressed enters a chamber via an inlet and exits the chamber through an outlet. The compression is a cyclical process in which the fluid is compressed by a reciprocating movement of a piston head. A plurality of compressor valve assemblies may be arranged around the chamber. The compressor valve assemblies may be switched between a close state and an open state due to a pressure difference across the compressor valve assemblies in response to reciprocating movements of the piston head.

BRIEF DESCRIPTION OF THE DRAWINGS

FIG. 1 shows the inlet valves in an opened position.

FIG. 3 shows the inlet valves in an opened position.

DETAILED DESCRIPTION

Figure 1:
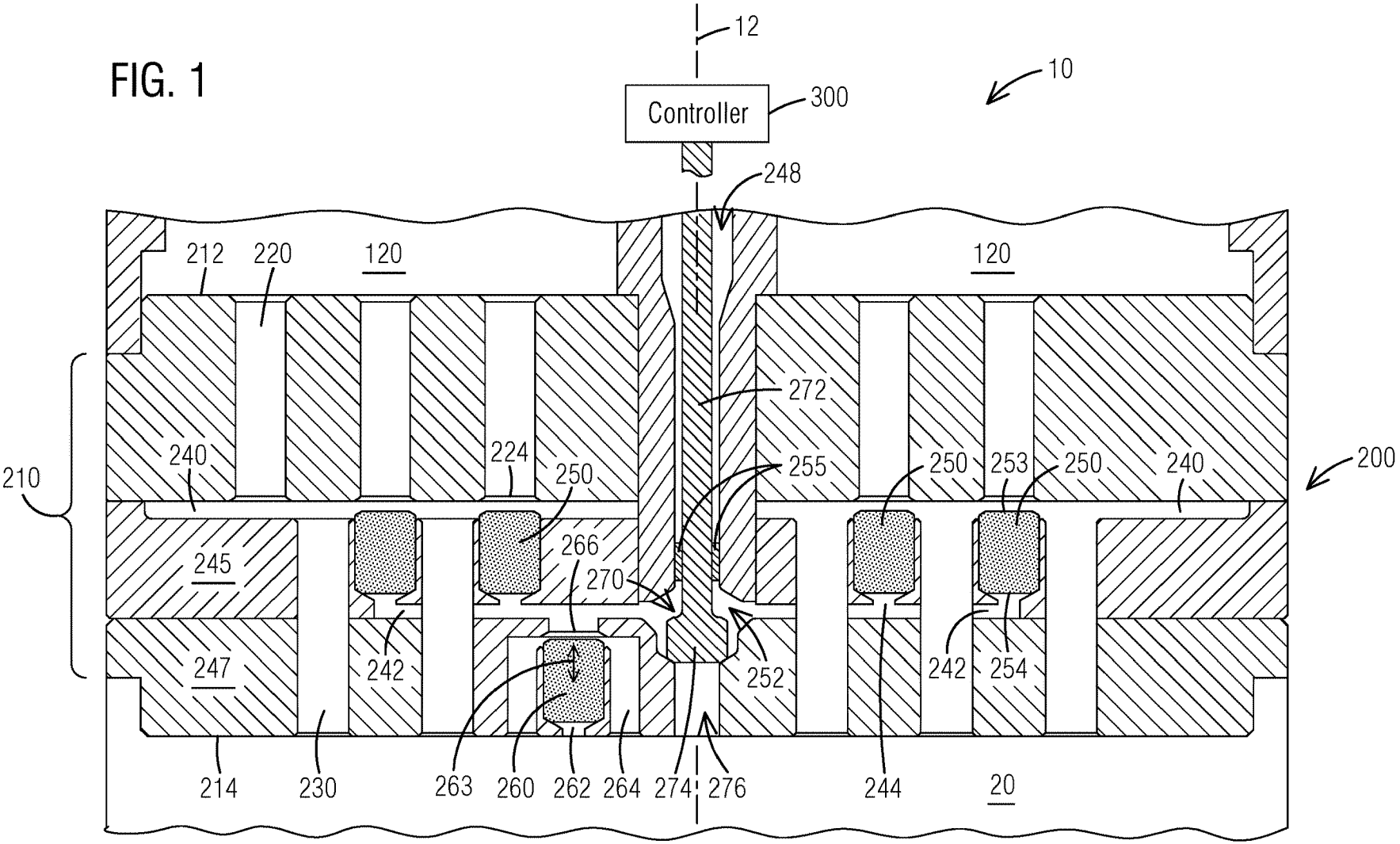
FIG. 1 shows a fragmentary, cross-sectional view of one example embodiment of a disclosed inlet valve system that may be used in a compressor, such as a reciprocating compressor, and includes a control valve and a check valve that jointly cooperate to open and close a plurality of inlet valves.

Turbomachinery, as may involve compressors, e.g., reciprocating compressors, etc.; without limitation may involve infinite step control (ISC), where, for example, one can unload a plurality of inlet valves of the compressor by holding the inlet valves open longer than their natural closing point during the compression stroke. This delayed closing of the inlet valves allows a portion of the working fluid to be expelled back from the compressor, even though the piston of the compressor may well be in its compression stroke, and therefore the compressor output decreases.

As will be appreciated by one skilled in the art, "infinite step control" means that the point during the compression stroke of the piston at which the inlet valves are permitted to close may be precisely selected from any of an infinite number of points along the travel of the piston, so that compression of the fluid in each cycle will not begin until the piston reaches that point, and thus any undesired quantity of working fluid can be expelled through the open inlet valves until the piston approaches the selected point. Thus, the output of the compressor can be selectively controlled. This was traditionally done by depressing a relatively complex finger/plunger assembly, such as may involve a hydraulic-based servomechanism. One known subsequent design eliminated the finger/plunger assembly and hydraulic servomechanism through use of an external control pressure to generate appropriate differential pressures to open and close the inlet valves.

Reliable and cost-effective techniques are disclosed herein to further improve turbomachinery, as may involve reciprocating compressors. Accordingly, disclosed embodiments eliminate use of any external control pressure to generate the differential pressures involved to open and close the inlet valves. Moreover, disclosed embodiments make use of a check valve cleverly arranged (e.g., fluidly coupled) between the cylinder chamber and the control chamber that, for example, can set and maintain the inlet valve system in an unloaded condition without having to stroke the control valve during each cycle. That is, disclosed embodiments simplify the control strategy involved to unload the cylinder chamber since such unloading (and maintaining the inlet valve system in an unloaded condition, for as long as desired) can now be implemented in a self-acting manner.

In the following detailed description, various specific details are set forth to provide a thorough understanding of such embodiments. However, those skilled in the art will understand that disclosed embodiments may be practiced without these specific details, that aspects of the present innovation are not limited to the disclosed embodiments, and that aspects of the present innovation may be practiced in a variety of alternative embodiments. Other instances, methods, procedures, and components, which would be well-understood by one skilled in the art have not been described in detail to avoid unnecessary and burdensome explanation.

Furthermore, various operations may be described as multiple discrete steps performed in a manner that is helpful for understanding embodiments of the present invention. However, the order of description should not be construed as to imply that these operations need be performed in the order they are presented, nor that they are even order dependent, unless otherwise indicated. Moreover, repeated usage of the phrase "in one embodiment" does not necessarily refer to the same embodiment, although it may.

It is noted that disclosed embodiments need not be construed as mutually exclusive embodiments, since aspects of such disclosed embodiments may be appropriately combined by one skilled in the art depending on the needs of a given application.

Figure 2:
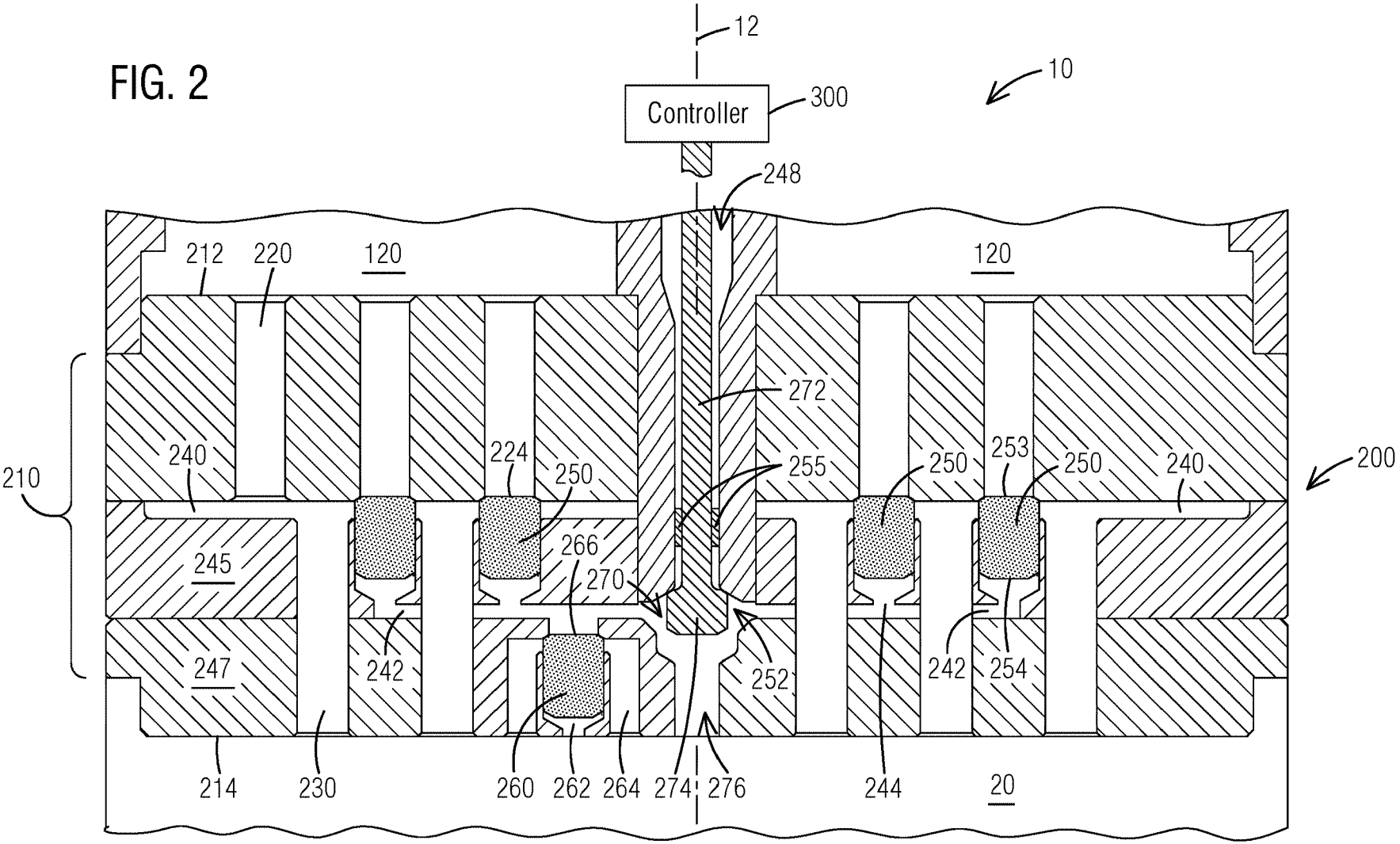
FIG. 2 shows the embodiment of the inlet valve system of FIG. 1 with the inlet valves in a closed position.

FIG. 1 shows a fragmentary cross-sectional view of one example embodiment of a disclosed inlet valve system 10 that may be fluidly coupled between an unloader chamber 120 and a cylinder chamber 20 of, for example, a reciprocating compressor. This is one example of turbomachinery that may benefit from disclosed embodiments; however, it will be appreciated that, in general, any system involving actuation of valve assemblies due to pressure differences may benefit from disclosed embodiments. A plurality of inlet valves 250, is movable between an open position (as shown in FIG. 1) and a closed position (as shown in FIG. 2). In one non-limiting embodiment, the plurality of inlet valves 250 may be part of a valve assembly 200.

In one non-limiting embodiment, valve assembly 200 may be configured with a cylindrical valve body 210 circumferentially disposed about a central axis 12 of inlet valve system 10 and may have a first axial end 212 opposite a second axial end 214.

In one non-limiting embodiment, the plurality of inlet valves 250 is disposed in a plurality of inlet valve ports 244 that may be arranged in a first portion 245 of cylindrical valve body 210. For example, each inlet valve port 244 at least partially contains a respective inlet valve of the plurality of inlet valves 250.

In one non-limiting embodiment, a plurality of first valve passages 220 extends (e.g., in a direction parallel to central axis 12) between the first axial end 212 of cylindrical valve body 210 and a first connective passage 240 (e.g., extending transverse to central axis 12). In one non-limiting embodiment, a plurality of second valve passages 230 extends (e.g., parallel to central axis 12) between the second axial end 214 of cylindrical valve body 210 and first connective passage 240. In one non-limiting embodiment, a second connective passage 242 extends (e.g., transverse to central axis 12) between the plurality of inlet valve ports 244. In one non-limiting embodiment, each of the first valve passages 220 has a respective inlet valve seating surface 224 adjacent first connective passage 240.

In one non-limiting embodiment, as elaborated in greater detail below, each inlet valve 250 is configured to move between a closed position and an opened position in response to a differential pressure, such as may develop between a front element surface 253 and a rear element surface 254 of each inlet valve. For example, when greater pressure is applied to rear element surface 254 than front element surface 253, the inlet valve seating surface 224 of a respective first valve passage 220 adjacent first connective passage 240 is engaged and the inlet valve is in the closed position (e.g., FIG. 2 or FIG. 4).

Conversely, when a greater pressure is applied to front element surface 253 than rear element surface 254, the inlet valve seating surface 224 of the respective first valve passage 220 adjacent first connective passage 240 is disengaged and the inlet valve is in the opened position (e.g., FIG. 1 or FIG. 3) and this permits, for example, fluid flow communication between unloader chamber 120 and cylinder chamber 20.

In one non-limiting embodiment, a control valve 270 (labelled 270' in FIGS. 3 and 4) is coupled to a controller 300 and is movable between a first position and a second position to close inlet valves 250. In one non-limiting embodiment, a check valve 260 (labelled 260' in FIGS. 3 and 4) is movable between a first position and a second position to open inlet valves 250.

Check valve 260 and control valve 270 is each respectively fluidly coupled to a control chamber 252, which is decoupled from any pressure control external to cylinder chamber 20. In one non-limiting embodiment, control valve 270 is arranged between cylinder chamber 20 and control chamber 252. In one non-limiting embodiment, check valve 260 is arranged between connective passage 242 and cylinder chamber 20. In one non-limiting embodiment, at least one seal 255 may be arranged to define a pressure boundary in control chamber 252.

In one non-limiting embodiment, check valve 260 may be disposed in a check valve port 262 arranged in a second portion 247 of cylindrical valve body 210, where first portion 245 of cylindrical valve body 210 is superposed over the second portion 247 of cylindrical valve body 210. For example, when inlet valves 250 first experience a given pressure front, there will be a certain lag for check valve 260 to experience such pressure front. Similarly, when check valve 260 first experiences a given pressure front, there will be a certain lag for inlet valves 250 to experience such pressure front.

In one non-limiting embodiment, when control valve 270 is in a first position (FIG. 1), check valve 260 is fluidly coupled to cylinder chamber 20 to set and maintain (if so desired) the inlet valve system in an unloaded condition. In this case, each inlet valve of the plurality of inlet valves 250 is in the opened position, and when control valve 270 is in a second position (FIG. 2), the inlet valve system is set in a loaded condition, where each valve of the plurality of inlet valves 250 is in the closed position.

In one non-limiting embodiment, control valve 270 may comprise a stem 272 disposed in a central bore 248. In one non-limiting embodiment, central bore 248 may extend between the first axial end 212 and the second axial end 214 of cylindrical valve body 210 and along central axis 12 of inlet valve system 10. In one non-limiting embodiment, control valve 270 has a control valve element 274 arranged at an axial end of stem 270 in control chamber 252. In the first position (FIG. 1) of control valve 270, stem 272 is axially extended so that the control valve element 274 closes a port 276 to inhibit flow communication with cylinder chamber 20.

In one non-limiting embodiment, a check valve passage 264 extends in second portion 247 of cylindrical valve body 210 from connective passage 242 to cylinder chamber 20. Check valve passage 264 has a check valve seating surface 266 adjacent connective passage 242. By way of example, when control valve 270 is in the first position (FIG. 1), fluid flow communication may be established with cylinder chamber 20 by way of check valve passage 264. More specifically, in this case, fluid flow communication with cylinder chamber 20 is controlled by engagement and disengagement (e.g., cyclical dynamic engagement/disengagement) of check valve 260 with check valve seating surface 266 in response to cyclical pressure variation in cylinder chamber 20 during operation of the compressor.

The dynamic engagement and disengagement (e.g., closing/opening) of check valve 260 in response to cyclical pressure variation in cylinder chamber 20 when control valve 270 is in the first position (FIG. 1) is schematically represented by twin-headed arrow 263 in FIG. 1. Essentially, pressure drop in cylinder chamber 20 (i.e., pressure drop involved during the opening of inlet valves 250) is trapped in control chamber 252 by way of the self-acting, dynamic behavior of check valve 260 in response to cyclical pressure variation in cylinder chamber 20 when control valve 270 is in the first position. This allows unloading the inlet valve system (and keeping the inlet valve system unloaded, if so desired) without any external pressure control connection.

By way of comparison, when control valve 270 is in the second position (FIG. 2), stem 272 is axially retracted so that port 276 is not closed by control valve element 274 and fluid flow communication is established between control chamber 252 and cylinder chamber 20 by way of port 276. In this case, a higher pressure that develops in cylinder chamber 20 compared to pressure in unloader chamber 120 allows developing a pressure differential that causes inlet valves 250 to move to the closed position.

It will be appreciated that in the embodiment described above in the context of FIGS. 1 and 2, control valve 270 and check valve 260 comprise separate and distinct valve assemblies, where, for example, check valve port 262 may be laterally offset relative to the central axis 12 of inlet valve system 10.

Figure 3:
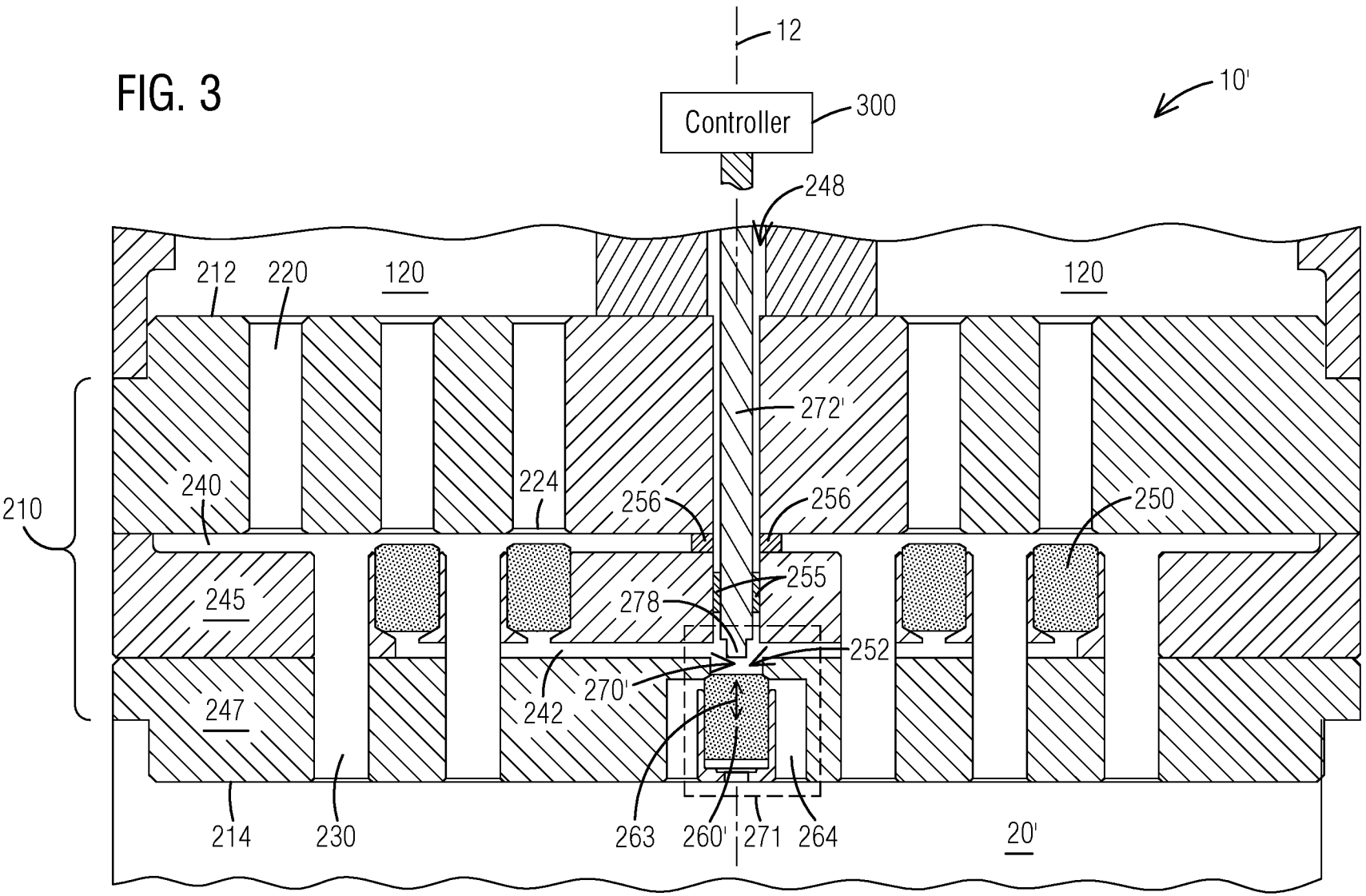
FIG. 3 shows a fragmentary, cross-sectional view of another example embodiment of a disclosed inlet valve system, where the control valve and the check valve constitute a common valve assembly.
Figure 4:
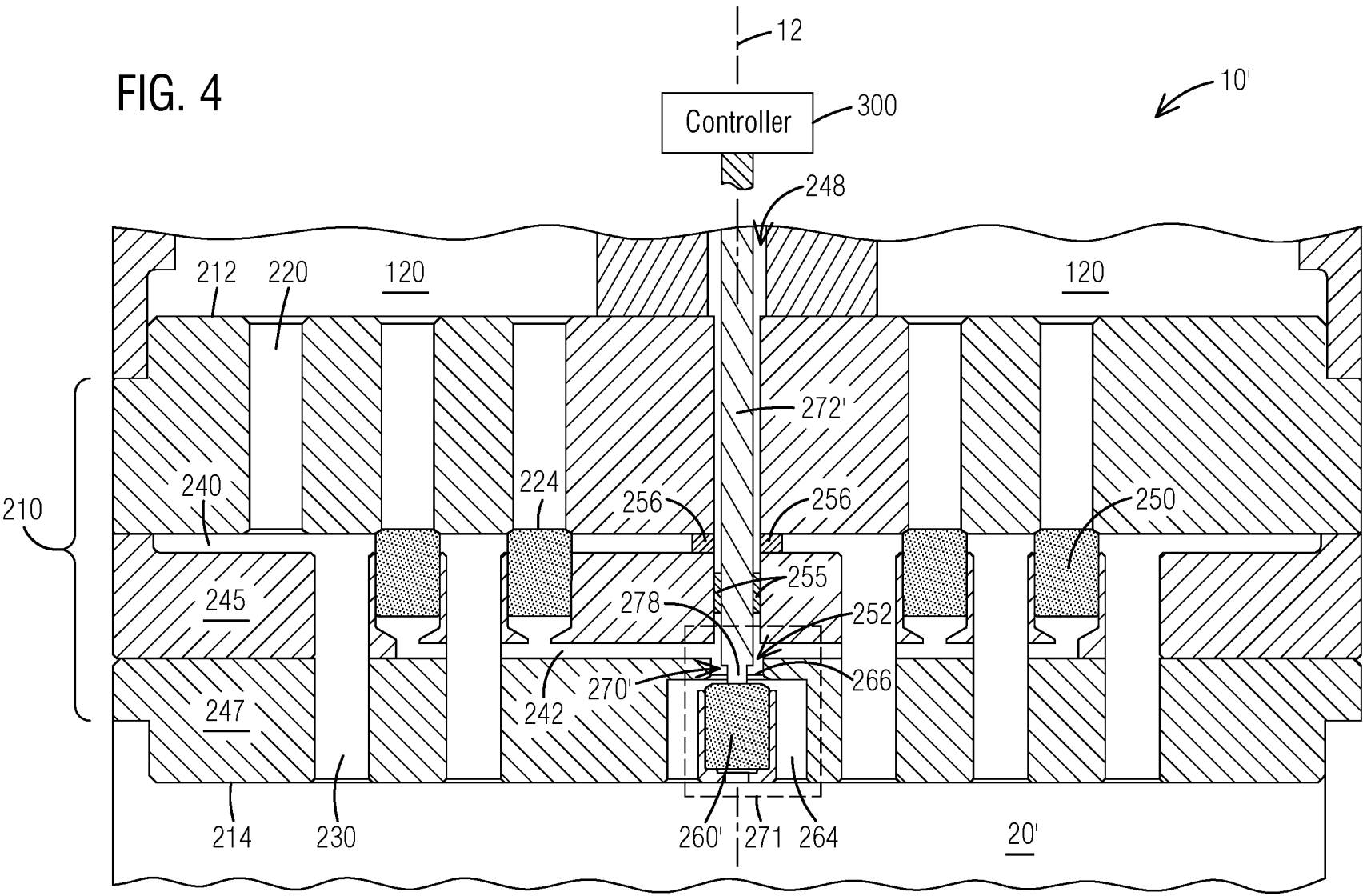
FIG. 4 shows the embodiment of the inlet valve system of FIG. 3 with the inlet valves in a closed position.

The description will now proceed in the context of the embodiment illustrated in FIGS. 3 and 4, where control valve 270' and check valve 260' comprise a common valve assembly 271 that may be coaxially aligned relative to central axis 12 of inlet valve system 10. It will be appreciated that the functionality provided by this embodiment is essentially the same functionality provided by the embodiment described above in the context of FIGS. 1 and 2 for opening and closing inlet valves 250. Therefore, the description below will focus on structural differences relative to the embodiment described above in the context of FIGS. 1 and 2.

In one non-limiting embodiment, control valve 270' may comprise a stem 272' having a finger 278 at an axial end of stem 272' in control chamber 252. In one non-limiting embodiment, at least one seal 255 may be arranged to define a pressure boundary in control chamber 252. In this embodiment, a further seal 256 may be used to seal the first connective passage 240 with respect to central bore 248. It will be appreciated that further seal 256 could be used in the embodiment illustrated in FIGS. 1 and 2, if, in a given application, stem 272 was not contained within an enclosure with walls that inhibit flow communication between central bore 248 and first connective passage 240, as illustrated in FIGS. 1 and 2.

In one non-limiting embodiment, when control valve 270' is in the first position (FIG. 3), stem 272' is axially retracted so that check valve 260' of common valve assembly 271 is responsive to pressure variation in cylinder chamber 20 during operation of the compressor. That is, when control valve 270' is in the first position, fluid flow communication is established with cylinder chamber 20 by way of check valve passage 264. More specifically, in this case, fluid flow communication with cylinder chamber 20 is controlled by engagement and disengagement (e.g., cyclical dynamic engagement/disengagement) of check valve 260' with check valve seating surface 266 (FIG. 4) in response to pressure variation in the cylinder chamber 20 during operation of the compressor.

Once again, the dynamic engagement and disengagement of check valve 260' in response to cyclical pressure variation in cylinder chamber 20 when control valve 270' is in the first position (FIG. 3) is schematically represented by twin-headed arrow 263 in FIG. 3. Essentially, pressure drop in cylinder chamber 20 (i.e., pressure drop involved during the opening of inlet valves 250) is trapped in control chamber 252 by way of the self-acting, dynamic behavior of check valve 260' in response to cyclical pressure variation in cylinder chamber 20 when control valve 270' is in the first position. This allows unloading the inlet valve system (and keeping the inlet valve system unloaded, if so desired) without any external pressure control connection.

By way of comparison, when control valve 270' is in the second position (FIG. 4), stem 272' is axially extended so that finger 278 forces the check valve 260' of common valve assembly 271 to an open position and fluid flow communication is established between control chamber 252 and cylinder chamber 20 by way of check valve passage 264. In each of the foregoing embodiments, controller 300 may be arranged to selectively control a timing to respectively actuate control valve to the first position and to the second position. In this case, the higher pressure that develops in cylinder chamber 20 compared to pressure in unloader chamber 120 in turn allows developing a pressure differential that causes inlet valves 250 to move to the closed position.

From the foregoing description, it will be appreciated FIGS. 1 and 2 illustrate two operating positions of one embodiment of the system. With reference to FIG. 1, (e.g., control valve 270 is in the first position) this figure may be used to conceptualize a point during the intake stroke of the piston. At this point, the pressure in cylinder chamber 20 is lower than the pressure in unloader chamber 120 such that inlet valves 250 open. As the piston stroke progresses, the pressure in cylinder chamber 20 begins to increase (e.g., cylinder volume begins to decrease) and this causes check valve 260 to move to engage check valve seating surface 266 and effectively trap the low pressure in control chamber 252 that allowed inlet valves 250 to open. As the piston stroke reverses, the pressure in cylinder chamber 20 eventually begins to decrease (e.g., cylinder volume begins to increase) and this causes check valve 260 to move to disengage check valve seating surface 266 and the relatively low pressure in cylinder chamber 20 in flow communication with the decreasing pressure in control chamber 252 permits inlet valves 250 to continue open. This process repeats itself (e.g., the dynamic behavior of check valve 260 involving closing/opening) so long as control valve 270 remains in the first position.

With reference to FIG. 2 (e.g., control valve 270 is in the second position), this figure may be used to conceptualize a point during the exhaust stroke of the piston. At this point, the pressure in cylinder chamber 20 is higher than the pressure in unloader chamber 120 such that inlet valves 250 move to the closed position. It is noted that FIGS. 3 and 4 may be used to respectively describe the same operational relationships described above in the context of FIGS. 1 and 2 for the embodiment depicted in FIGS. 3 and 4.

In operation, disclosed embodiments implement an inlet valve system that eliminates use of any external control pressure to generate the differential pressures to open and close the inlet valves. Moreover, disclosed embodiments simplify the control strategy involved to unload the cylinder chamber since such unloading can now be implemented in a self-acting manner. That is, without having to stroke a control valve during each cycle for on/off unloading. It will be appreciated that disclosed embodiments may be used in a given reciprocating compressor regardless of whether or not such compressor implements infinite step control (ISC).

While embodiments of the present disclosure have been disclosed in exemplary forms, it will be apparent to those skilled in the art that many modifications, additions, and deletions can be made therein without departing from the scope of the invention and its equivalents, as set forth in the following claims.

What is claimed is:

1. An inlet valve system for a cylinder chamber of a compressor, comprising:

a plurality of inlet valves each being movable between an open position and a closed position in response to a pressure differential, the plurality of inlet valves arranged between an unloader chamber and the cylinder chamber of the compressor;

a control valve coupled to a controller and movable between a first position and a second position to close the inlet valves, wherein the control valve comprises a stem disposed in a central bore;

a check valve movable between a first position and a second position to open the inlet valves, the check valve and the control valve each respectively fluidly coupled to a control chamber, which is decoupled from any pressure control external to the cylinder chamber; and at least one seal arranged at the stem to define a pressure boundary between the control chamber and the central bore, the pressure boundary being continuously defined by the at least one seal regardless of the position of the control valve;

wherein, when the control valve is in the first position, the check valve is fluidly coupled to the cylinder chamber, and each inlet valve of the plurality of inlet valves is in the opened position, and, when the control valve is in the second position, each valve of the plurality of inlet valves is in the closed position, wherein, when the control valve is in the first position, pressure drop in the cylinder chamber is trapped in the control chamber by way of the check valve in response to cyclical pressure variation in the cylinder chamber, and further by way of the pressure boundary defined by the at least one seal.

2. The inlet valve system of claim 1, wherein the control valve is arranged between the cylinder chamber and the control chamber.

3. The inlet valve system of claim 1, wherein the check valve is arranged between a connective passage in fluid flow communication with the inlet valves and the cylinder chamber.

4. The inlet valve system of claim 3, wherein the control valve has a control valve element arranged at an axial end of the stem in the control chamber, wherein in the first position of the control valve, the stem is axially extended so that the control valve element closes a port to inhibit flow communication with the cylinder chamber.

5. The inlet valve system of claim 4, further including a check valve passage extending from the connective passage to the cylinder chamber, the check valve passage having a check valve seating surface adjacent the connective passage, wherein, when the control valve is in the first position, to inhibit flow communication with the cylinder chamber, the fluid flow communication with the cylinder chamber being controlled by engagement and disengagement of the check valve with the check valve seating surface in response to cyclical pressure variation in the cylinder chamber during operation of the compressor.

6. The inlet valve system of claim 4, wherein in the second position of the control valve, the stem is axially retracted so that the port is not closed by the control valve element and fluid flow communication is established between the control chamber and the cylinder chamber by way of the port.

7. The inlet valve system of claim 1, wherein the control valve and the check valve comprise separate and distinct valve assemblies, wherein the check valve port is laterally offset relative to a central axis of the inlet valve system.

8. The inlet valve system of claim 1, wherein the control valve and the check valve comprise a common valve assembly coaxially aligned relative to a central axis of the inlet valve system.

9. The inlet valve system of claim 8, wherein the stem has a finger at an axial end of the stem in the control chamber, wherein in the first position of the control valve, the stem is axially retracted so that the check valve of the common valve assembly is responsive to the cyclical pressure variation in the cylinder chamber during operation of the compressor.

10. The inlet valve system of claim 9, wherein the common valve assembly is arranged between a connective passage in fluid flow communication with the inlet valves and the cylinder chamber.

11. The inlet valve system of claim 9, further including a check valve passage extending from connective passage to the cylinder chamber, the check valve passage having a check valve seating surface adjacent the connective passage, wherein, when the control valve is in the first position, fluid flow communication is established with the cylinder chamber by way of the check valve passage, the fluid flow communication with the cylinder chamber being controlled by engagement and disengagement of the check valve with the check valve seating surface in response to the cyclical pressure variation in the cylinder chamber during operation of the compressor.

12. The inlet valve system of claim 11, wherein, in the second position of the control valve, the stem is axially extended so that the finger forces the check valve of the common valve assembly to an open position and fluid flow communication is established between the control chamber and the cylinder chamber by way of the check valve passage.

13. The inlet valve system of claim 1, wherein the controller is arranged to selectively control a timing to respectively actuate the control valve to the first position and to the second position.

14. A reciprocating compressor comprising the inlet valve system set forth in claim 1 and constituting the compressor therein.

15. An inlet valve system for a cylinder chamber of a compressor, comprising:

a plurality of inlet valves each being movable between an open position and a closed position in response to a pressure differential, the plurality of inlet valves arranged between an unloader chamber and the cylinder chamber of the compressor;

a control valve coupled to a controller and movable between a first position and a second position to close the inlet valves, wherein the control valve comprises a stem disposed in a central bore;

a check valve movable between a first position and a second position to open the inlet valves, the check valve and the control valve each respectively fluidly coupled to a control chamber, which is decoupled from any pressure control external to the cylinder chamber; and at least one seal arranged at the stem to define a pressure boundary between the control chamber and the central bore, wherein, when the control valve is in the first position, the check valve is fluidly coupled to the cylinder chamber, and each inlet valve of the plurality of inlet valves is in the opened position, and, when the control valve is in the second position, each valve of the plurality of inlet valves is in the closed position, wherein, when the control valve is in the first position pressure drop in the cylinder chamber is trapped in the control chamber by way of the check valve in response to cyclical pressure variation in the cylinder chamber, wherein the check valve is laterally offset relative to a central axis of the inlet valve system.

16. The inlet valve system of claim 15, wherein the control valve is arranged between the cylinder chamber and the control chamber.

17. The inlet valve system of claim 15, wherein the check valve is arranged between a connective passage in fluid flow communication with the inlet valves and the cylinder chamber.

18. The inlet valve system of claim 17, wherein the control valve has a control valve element arranged at an axial end of the stem in the control chamber, wherein in the first position of the control valve, the stem is axially extended so that the control valve element closes a port to inhibit flow communication with the cylinder chamber.

19. The inlet valve system of claim 18, further including a check valve passage extending from the connective passage to the cylinder chamber, the check valve passage having a check valve seating surface adjacent the connective passage, wherein, when the control valve is in the first position, to inhibit flow communication with the cylinder chamber, the fluid flow communication with the cylinder chamber being controlled by engagement and disengagement of the check valve with the check valve seating surface in response to cyclical pressure variation in the cylinder chamber during operation of the compressor.

20. The inlet valve system of claim 19, wherein in the second position of the control valve, the stem is axially retracted so that the port is not closed by the control valve element and fluid flow communication is established between the control chamber and the cylinder chamber by way of the port.

21. The inlet valve system of claim 15, wherein the control valve and the check valve are separate and distinct valve assemblies.

22. The inlet valve system of claim 15, wherein the controller is arranged to selectively control a timing to respectively actuate the control valve to the first position and to the second position.

23. An inlet valve each being system for a cylinder chamber of a compressor, comprising:

a plurality of inlet valves movable between an open position and a closed position in response to a pressure differential, the plurality of inlet valves arranged between an unloader chamber and the cylinder chamber of the compressor;

a control valve coupled to a controller and movable between a first position and a second position to close the inlet valves, wherein the control valve comprises a stem disposed in a central bore;

a check valve movable between a first position and a second position to open the inlet valves, the check valve and the control valve each respectively fluidly coupled to a control chamber, which is decoupled from any pressure control external to the cylinder chamber; and at least one seal arranged at the stem to define a pressure boundary between the control chamber and the central bore, wherein, when the control valve is in the first position, the check valve is fluidly coupled to the cylinder chamber, and each inlet valve of the plurality of inlet valves is in the opened position, and, when the control valve is in the second position, each valve of the plurality of inlet valves is in the closed position, wherein, when the control valve is in the first position pressure drop in the cylinder chamber is trapped in the control chamber by way of the check valve in response to cyclical pressure variation in the cylinder chamber, wherein, in the second position of the control valve, the stem is axially extended so that an axial end of the stem mechanically forces the check valve to an open position.

24. The inlet valve system of claim 23, wherein the control valve and the check valve comprise a common valve assembly coaxially aligned relative to a central axis of the inlet valve system.

25. The inlet valve system of claim 23, wherein the axial end of the stem comprises a finger, wherein in the first position of the control valve, the stem is axially retracted so that the check valve of the common valve assembly is responsive to the cyclical pressure variation in the cylinder chamber during operation of the compressor.

26. The inlet valve system of claim 25, wherein the common valve assembly is arranged between a connective passage in fluid flow communication with the inlet valves and the cylinder chamber.

27. The inlet valve system of claim 26, further including a check valve passage extending from the connective passage to the cylinder chamber, the check valve passage having a check valve seating surface adjacent the connective passage, wherein, when the control valve is in the first position, fluid flow communication is established with the cylinder chamber by way of the check valve passage, the fluid flow communication with the cylinder chamber being controlled by engagement and disengagement of the check valve with the check valve seating surface in response to the cyclical pressure variation in the cylinder chamber during operation of the compressor.

28. The inlet valve system of claim 27, wherein, in the second position of the control valve, the stem is axially extended so that the finger forces the check valve of the common valve assembly to an open position of the first and second positions of the check valve and fluid flow communication is established between the control chamber and the cylinder chamber by way of the check valve passage.

29. The inlet valve system of claim 23, wherein the controller is arranged to selectively control a timing to respectively actuate the control valve to the first position and to the second position.

* * * * *